United States Patent [19]

Nienaber et al.

[11] Patent Number: 4,626,835

[45] Date of Patent: Dec. 2, 1986

[54] RGBI DIGITAL VIDEO CONTROL SYSTEM HAVING INTENSITY LEVEL CONTROL AND OVERALL IMAGE STRENGTH CONTROL

[75] Inventors: David K. Nienaber, Des Plaines; Amir Sheikholeslami, Mt. Prospect, both of Ill.

[73] Assignee: Zenith Electronics Corporation, Glenview, Ill.

[21] Appl. No.: 668,768

[22] Filed: Nov. 6, 1984

[51] Int. Cl.[4] ..... G09G 1/28

[52] U.S. Cl. ..... 340/703; 358/27

[58] Field of Search ..... 340/701, 703; 358/27, 358/22, 28, 29, 82

[56] References Cited

U.S. PATENT DOCUMENTS 3,710,011 1/1973 Altemus et al. ..... 358/82
4,178,608 12/1979 Shirato ..... 358/27
4,271,409 6/1981 Filliman ..... 340/703
4,361,850 11/1982 Nishimura ..... 340/701
4,386,345 5/1983 Narveson et al. ..... 340/703

*Primary Examiner*—John W. Shepperd

[57] ABSTRACT

An RGBI digital video control system for a color video monitor has first means for varying the level of received digital color video information, typically sixteen-color, four bit information, and second means for providing graduated RGB analog output signals in response to the varied input signals. An overall image strength control circuit varies the maximum intensity of the RGB output signals for a standard video processor. A second intensity control circuit, typically responsively coupled to the overall image strength control circuit, independently varies the intensity or brightness components for the RGB drive signals. Logic circuitry means produce non-standard colored shades to be interposed between the input signals and the graduation circuit. The logic circuit may be modified to produce desired non-standard shades in response to pre-selected input conditions.

9 Claims, 6 Drawing Figures

RGBI DIGITAL VIDEO CONTROL SYSTEM HAVING INTENSITY LEVEL CONTROL AND OVERALL IMAGE STRENGTH CONTROL

BACKGROUND OF THE INVENTION

The present invention relates generally to the video signal processing art. More particularly, the present invention relates to the improved processing of digital color video information for display on a color television monitor.

Color video monitors are presently used in a number of environments. Although sometimes used in the home entertainment environment, color video monitors are more frequently used in conjunction with a controlled local input signal such as would be generated by a computer. In such a situation, varied demands may be made for flexible adaptation of a basic video monitor to a number of different computer systems. Accordingly, it is desired to have a color video monitor which may be readily and inexpensively adapted to be compatible with a large number of computer systems.

The present standard for color video display is frequently referred to as "sixteen color". As the name implies, sixteen color video information may be processed to allow for display of sixteen different colors on the video display tube. The generation of the actual colors on the picture screen may be accomplished by a video processor in any number of methods as are well known in the art.

As is well known in the digital processing art, a four bit digital signal is required to define a sufficient number of states to identify sixteen separate colors for activating the appropriate video color generation for display. However, the typical video processing system relies upon just three inputs, red, green, and blue (RGB). This limits the typical digital color video system to the eight color states which may be identified by the three bit inputs of a typical digital RGB system. A sixteen color digital system may be achieved by adding a fourth bit, which may typically be referred to as an intensity bit (I) to obtain an RGBI video system.

In one such sixteen color, four bit system, the intensity bit may be used to add an additional component of "white" color to any of the red, green or blue components of the typical system. Accordingly, when the intensity bit is high, a white component will be added to the red, green or blue which will cause any of those colors to be a shade brighter than would typically be generated. For example, a normally pure red signal would become pink and a normally pure blue signal would become light blue. In contrast, when the intensity bit was low, no additional light component would be added to the original signal and pure red would appear as normal red and pure blue would appear as normal blue. In such a system, the eight colors associated with the three bit, eight color system may be generated and a correspondingly brighter shade of each of those eight colors may likewise be generated.

Once the sixteen different colors are identified, it is desirable to be able to control the resultant picture's "vividness" or image strength. Accordingly, it is desirable to have circuitry compatible with digital input signals that can vary the overall image strength. It may also be desirable to provide circuitry for separately controlling the impact or weight of the various components of the video information, such as the intensity information, to further control the displayed image.

Additionally, it may be desired to generate or provide somewhat altered colors than would typically be associated with the eight or sixteen color system. For example, a new "brown" color may be desired at the end video picture. Accordingly, it is desired that an RGB processing circuit be able to distinguish those input conditions under which a different color is desired and appropriately identify the same for the video processor.

Furthermore, it is desirable that the eight color or the sixteen color video control system be compatible with current video processing systems which are adapted to receive the traditional RGB analog inputs. Accordingly, it is desired to provide a digital RGB control system which may accurately identify any of sixteen different color shades for video processing without requiring additional analog inputs at the video processing stage.

Accordingly, it is the principal object of the present invention to provide desired circuitry and generally overcome the deficiencies in the prior art.

It is a primary object of the present invention to provide a R,G,B,I digital video control system for receiving four bits of digital color video information and providing three analog output signals which, when combined, cause the appropriate, desired color to be displayed by the video processor.

It is still a further object of the present invention to provide for an overall RGB gain or level control in conjunction with the other stated objectives.

It is still a further object of the present invention to provide a second gain control which selectively controls the gain of the intensity in a sixteen color, four bit video system.

It is still a further object of the present invention to provide a digital RGBI intensity control system which is compatible with current video processing systems.

BRIEF DESCRIPTION OF THE FIGURES

The features of the present invention which are believed to be novel are set forth with particularity in the appended claims. The invention, together with its objects and the operation thereof may best be understood when taken in conjunction with the following detailed description and the drawings in which like elements are identified by like reference numerals and of which:

DETAILED DESCRIPTION OF THE INVENTION

The present invention generally provides an improved RGBI digital video control system for color video monitors. More particularly, the present invention provides a control means for processing received digital color video information and providing intermediate video information signals to a graduation means which may then provide analog RGB signals which when combined, can cause the correct and desired color to be displayed on a video monitor. More particularly, the present invention is adapted to provide a sixteen color video image from a four bit input comprised generally of red, green and blue bits of color video information (R,G,B) in conjunction with a fourth bit of video intensity information (I). In more specific embodiments, the present invention allows for an individual intensity signal gain control which may be functionally tied to the overall video gain control. Overall flexibility is provided in allowing RGB gain or level control for four bit, sixteen color video information processed through a three analog input RGB video processor.

Additionally, the present invention, within its control section, may logically analyze the received four bit information to decide whether to generate a non-standard color or a different shade of a standard color.

Figure 1:
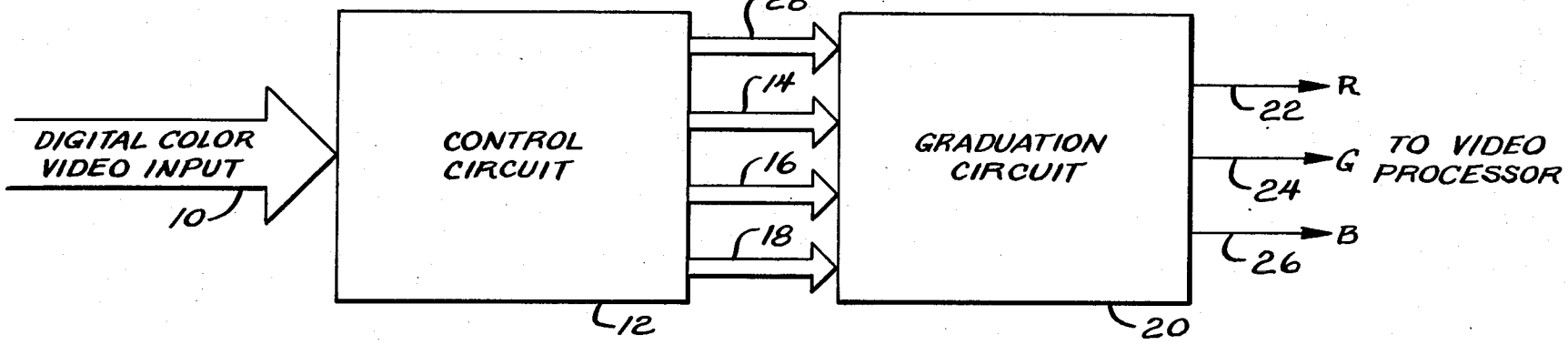
FIG. 1 is a generalized representational block diagram of the preferred embodiment of the present invention.

Referring now to FIG. 1, therein is shown a general block diagram of one embodiment of the present invention. Digital color video information is received via a bus 10 and processed by a control circuit 12. The output (intermediate video signals) of control circuit 12 is communicated via busses 14, 16 and 18 to a weighting or graduation circuit 20. Graduation circuit 20 then generates analog RGB output signals on lines 22, 24 and 26, respectively, based upon preselected criteria and the particular video information received via busses 14, 16 and 18. Additionally, weighting circuit 20 may be controlled via a line 28 by control circuit 12 to perform overall gain or image strength control. Further, as explained in more detail below, control circuit 12 may include individual circuits for providing a logic shade selection function and an intensity control function.

Figure 2:
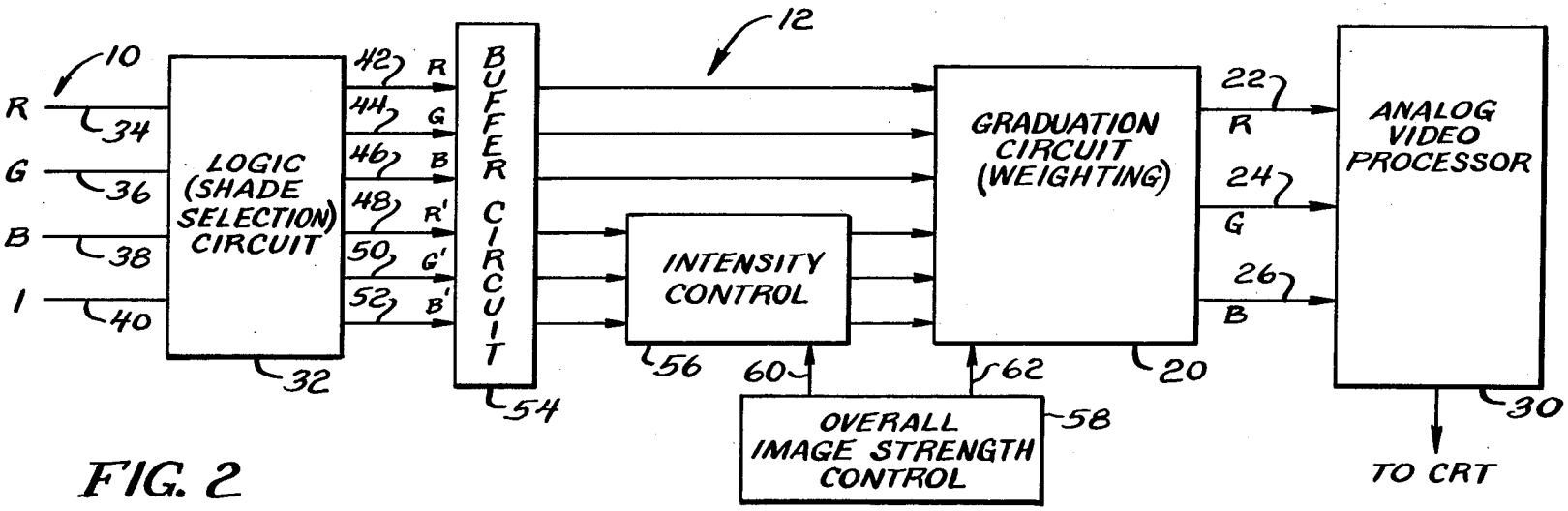
FIG. 2 is a more detailed representational block diagram of the preferred embodiment of the present invention.

The present invention may be further understood by reference to the greater detail of accompanying FIG. 2. FIG. 2 generally illustrates the control circuit 12 showing its component circuits in block form and the weighting circuit 20 with its outputs connected to analog video processor 30. More particularly, an initial logic circuit 32 receives the R, G, B and intensity information via lines 34, 36, 38 and 40, respectively, which generally comprise the input bus 10 as shown in FIG. 1. Logic circuit 32 may then process the four bit video information received via the R,G,B and I bits to provide intermediate outputs on lines 42, 44, 46, 48, 50 and 52 to a buffer cirucit 54.

In one embodiment, the RGB signals received on lines 34, 36 and 38 are passed straight through logic circuit 32 to form corresponding R, G, and B signals on lines 42, 44 and 46, respectively. Likewise, in one embodiment, the intensity information received on line 40 is passed straight through logic circuit 32 to provide intensity information on lines 48, 50 and 52, respectively. In this embodiment, lines 42 and 48 represent R and R′ information, respectively. Similarly, lines 44 and 50 represent G and G′ information and lines 46 and 52 represent B and B′ information, respectively. In this fashion, the intermediate signals present on lines 42, 44, 46, 48, 50 and 52 may be thought of as three intermediate, two bit color video information signals, i.e., RR′ GG′ and BB′. These three, two bit color video signals may then be buffered via a buffer circuit 54 and passed on for processing in graduation circuit 20.

In one embodiment of the present invention, the R′, G′ and B′ signals may be processed through an intensity control circuit 56 in which their level may be controlled independently of the R, G and B bits of each two bit intermediate video color signal.

Intensity control circuit 56 allows the R′, G′ and B′ signals to be varied to provide greater or lesser distinction between these colors for which the intensity input bit is high and those for which it is low. Alternatively, the gain of intensity control circuit 56 may be set at zero which will reduce the sixteen color system to an eight color system. The output of intensity control circuit 56, the three intermediate, two bit signals, may be supplied to the graduation circuit 20 for generation of the weighted R, G and B analog output signals on lines 22, 24 and 26. Graduation circuit 20 is described in more detail below in conjunction with the discussion of accompanying FIG. 4, but generally comprises a weighting circuit which supplies each of the analog RGB signals in one of four states, resulting from the combination of the two available bits of video information for each color, red, green and blue.

In the embodiment illustrated in FIG. 2, an overall image strength or gain control 58 may control the upper limit of the values generated by intensity control circuit 56 via a line 60 and the values generated by graduation circuit 20 via a line 62. In this fashion, although the intensity bits of the three, two bit signals may be controlled independently of the standard color information bits, overall image strength control circuit 58 still regulates the upper intensity limit.

Figure 3:
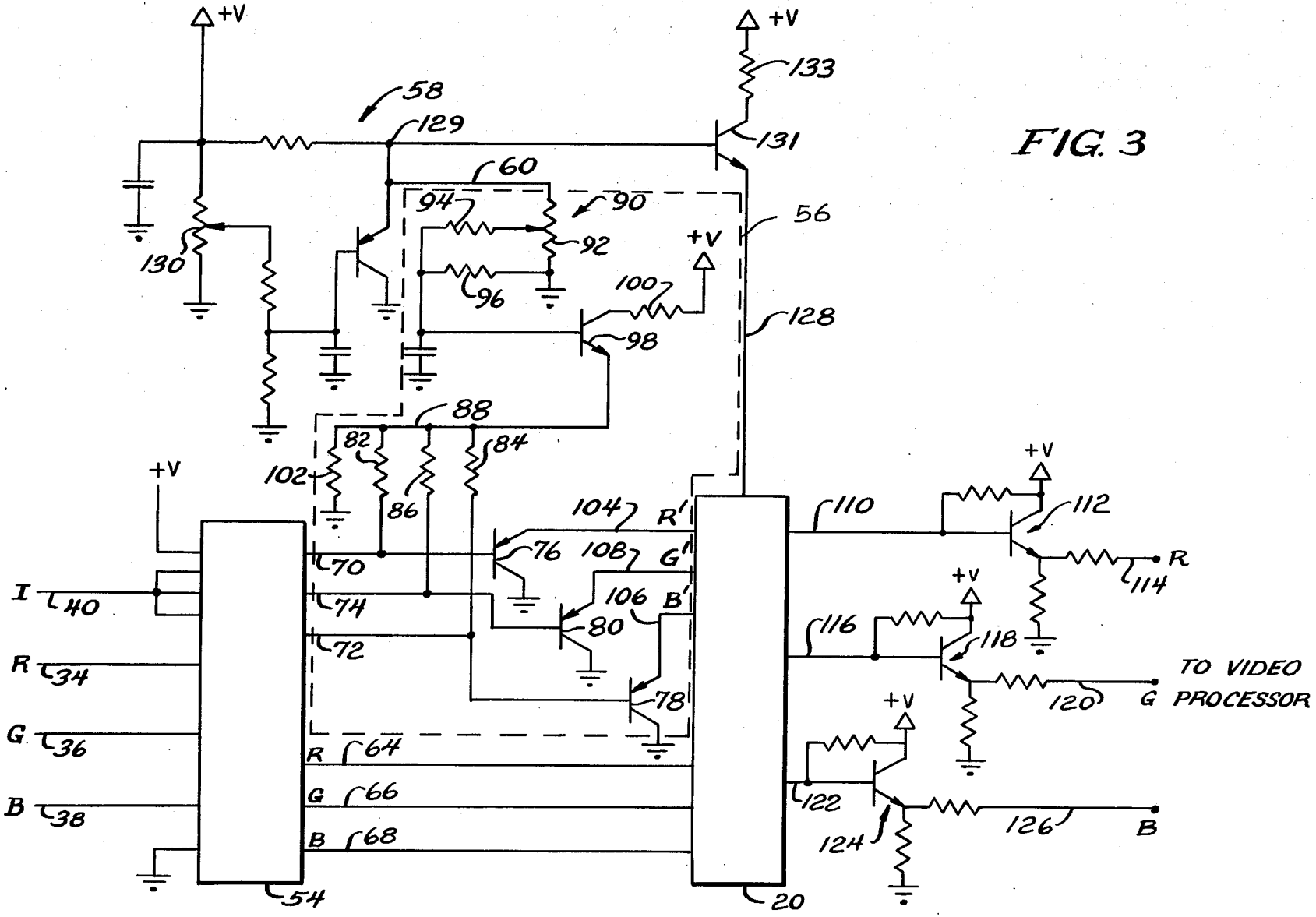
FIG. 3 is a schematic diagram which represents one embodiment of the present invention as illustrated in FIG. 2.

The embodiment of FIG. 2 may be more fully understood by reference to the detailed schematic of FIG. 3 which generally shows one preferred embodiment of the present invention. Red (R), green (G), blue (B) and intensity (I) input digital color information is received on the left in FIG. 3 via lines 34, 36, 38 and 40, respectively. In the embodiment of FIG. 3, logic circuit 32 is omitted and the received video information is provided directly to the buffer circuit 54. Buffer circuit 54 may be any desired buffer circuit, but it is envisioned that in the preferred embodiment it will comprise an open collector buffer chip. Buffer circuit 54 receives the R,G,B and I information on lines 34, 36, 38 and 40, and provides R, G and B output information on lines 64, 66 and 68, respectively. Additionally, buffer circuit 54 provides R′ G′ and B′ output information on lines 70, 72 and 74, respectively, which are coupled to the intensity control circuit 56. When logic circuit 32 is omitted from the circuitry of the invention, it is envisioned that each of the R′, G′ and B′ bits will have the same digital level as the I input bit.

Intensity control circuit 56 generally comprises three grounded collector transistors 76, 78 and 80, each tied to a base resistor 82, 84 and 86, respectively. Each of these base resistors is then tied to a common node 88, at which the voltage is controlled by a variable voltage supply circuit 90.

Variable voltage supply circuit 90 comprises a potentiometer 92 coupled to node 88 via resistors 94 and 96 through a transistor 98. Transistor 98 receives current through a resistor 100 from a voltage supply. In conjunction with a resistor 102, a voltage divider network is created which through the action of potentiometer 92 may control the voltage at node 88, which correspondingly controls the voltage supplied through transistor 76 as the R′ signal on a line 104, the voltage through transistor 78 as the B′ signal on a line 106, and the voltage through transistor 80 as the G′ signal on a line 108.

When the R′, G′ and B′ signals have been developed on their respective output lines from intensity control circuit 56, they are processed in conjunction with the R, G and B information originally received by the graduation circuit 20. More particularly, R′ information on line 104 is combined with the R information on line 64 in graduation circuit 20 to create a weighted output on a line 110 which then passes through a general buffer circuit 112 to present the output red (R) information on a line 114. Similarly, the B′ information on line 106 is combined in graduation circuit 20 with the B information present on line 68 to present a weighted signal on a line 116 which is then processed through a general buffer 118 to present the blue (B) output signal on a line 120. Likewise, the G′ information on line 108 is combined in graduation circuit 20 with the G information present on line 66 to create a weighted signal on a line 122 which is processed through a general buffer circuit 124 to create the green (G) output information on a line 126.

The overall level of the output signals on line 110, 116 and 122 from circuit 20 is controlled via the overall image strength control circuit 58 which is coupled to graduation circuit 20 via a line 128 and is generally controlled by a potentiometer 130 which may be controlled by the consumer to set the overall picture gain level.

Overall image control circuit 58 generally comprises a voltage divider network as shown to control the voltage level at node 129. This voltage level may then be supplied to line 128 via emitter follower transistor 131 which draws current from a voltage source through resister 133.

As mentioned above, the R, G, and B output signals on lines 114, 126 and 120, respectively, are desired to each have one of four discrete levels. In the preferred embodiment, these four levels are referred to as zero, low, medium, and high. That is, for example, if the red output on line 114 was at zero, then no red video color information would be sent to the video processor. On the other hand, if the red output signal on line 114 was high, then a full measure of red information would be supplied to the video processor. In comparison, if the green information on line 126 were at high and the red information on line 114 was at medium, then the voltage signal indicative of the red information would be at a medium level compared to the voltage level of the green information on line 126. The voltage level of the high state of each color is regulated by the overall image strength of the picture as controlled by circuit 58. In this fashion, the four bit color video information originally received on lines 34, 36, 38 and 40 may be processed through the RGBI control circuit of the present invention, and RGB analog output signals, each having four discrete levels, may be outputted to a video processor for the generation of sixteen different colors without need for the video processor to discretely identify each of the sixteen possible combinations in the four bit information as received.

Three lines of four-state information would normally yield up to sixty-four different color combinations. However, since the R′, B′, G′ bits are all controlled by one input, the system is limited to sixteen different color combinations.

The function of the circuitry of the present invention may be further appreciated by reference to the following Table I which is representative of typical RGB analog output levels. In Table I, R information is given by way of example; G or B values would be the same.

TABLE I

| R | R′ | R output |
|---|---|---|
| 1 | 1 | high |
| 0 | 1 | low |
| 1 | 0 | medium |
| 0 | 0 | zero |

In the embodiment of FIG. 3, the R′ input of Table I will always have the same value as the intensity input on line 40. Accordingly, if red information is present and the intensity bit is high, then a full measure of white information will be added to the red information and a pink signal will be generated by the video processor in response to the full signal present on line 114. In contrast, if red information is present and the intensity bit is low, then a standard red shade will be generated by the video processor in response to the medium discrete level present on line 114.

Figure 4:
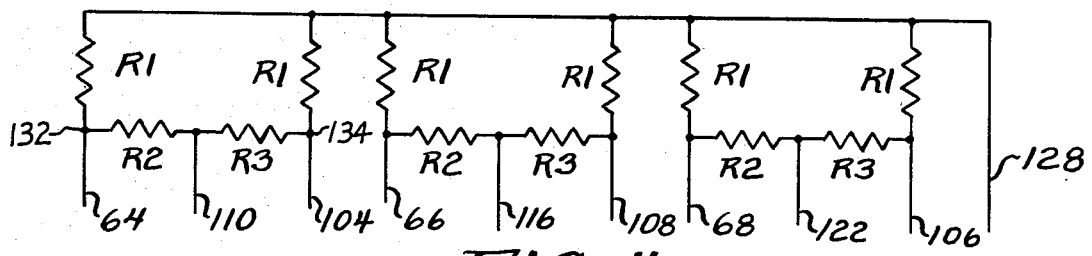
FIG. 4 is a schematic diagram which represents one embodiment of a weighting or graduation circuit for generation of video-processor-compatible RGB analog output signals.

The zero, low, medium and high discrete levels of each of the RGB outputs may be provided by the graduation circuit 20 in any acceptable fashion. In the preferred embodiment of the present invention, the circuitry of FIG. 4 may be utilized to accomplish that weighting function in response to the essentially digital information received at the R, G, B, and I inputs. As illustrated in FIG. 4, graduation circuit 20 comprises a resister matrix. In the resister matrix of FIG. 4, R1, R2 and R3 respectively identify discrete resister values. The R2 value is preferably approximately five times that of the R1 value and R3 is preferably approximately twice the value of R2. As explained above, the top level of the resister matrix is connected by line 128 to the overall picture gain control circuit 58 which will determine the top level of the output signals on line 110, 116, and 122. As is well known in the art, when the received R′ information on line 64 is high and the intensity information received on line 104 is low, a voltage divider network is set up between nodes 132 and 134. Because R3 is approximately twice R2, the voltage output on line 110 will then be at approximate medium level compared to the full "R" value present on line 64. Accordingly, each of the output signals from graduation circuit 20 may be generated in a like manner in response to the appropriate R′, R, G′, G and B′, B input signals.

It may sometimes be desired that an additional shade or color be substituted for the common sixteen colors typically generated in response to the corresponding four bit input information. For example, a brown shade may be desired at the video output screen. This may be accomplished by inserting the logic selector circuit 32 into the circuit of FIG. 3 prior to the buffer stage 54. Brown may be thought to be the combination of high red and medium green. Because in the embodiment of FIG. 3, the intensity bit on line 40 must be high in order to produce a high red output on line 114 (as explained above in conjunction with the first entry of Table I), it becomes necessary to logically alter the output determination for the R′ bit before the R and R′ signals are combined in graduation circuit 20. The general equation for determining the R′ signal to produce a brown shade is given below by Equation No. 1.

$$R' = I + R \cdot G \cdot \overline{B} \quad (1)$$

Figure 5:
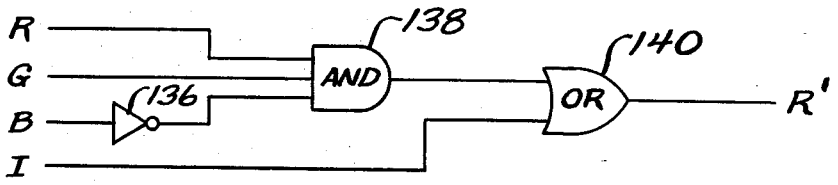
FIG. 5 is a representational logic schematic of one implementation for producing a non-traditional color shade.

Equation No. 1 is further illustrated in the logic diagram of FIG. 5 which is a general representation of the combination of the R, G, B, and I input signals through inverter gate 136, and gate 138, and OR gate 140 to create a modified R′. In this instance, when the R, G, B, and I inputs are high, high, low and low, respectively, the combination of the high red and medium green signals at lines 114 and 126 will be sent to the analog video processor which will then create a brown tone as is desired.

It will be appreciated by those skilled in the art that any number of logic circuits may be substituted for that of FIG. 5. Likewise, it will be appreciated by those skilled in the art that any other desired tone or shade may be generated in a very similar fashion.

Figure 6:
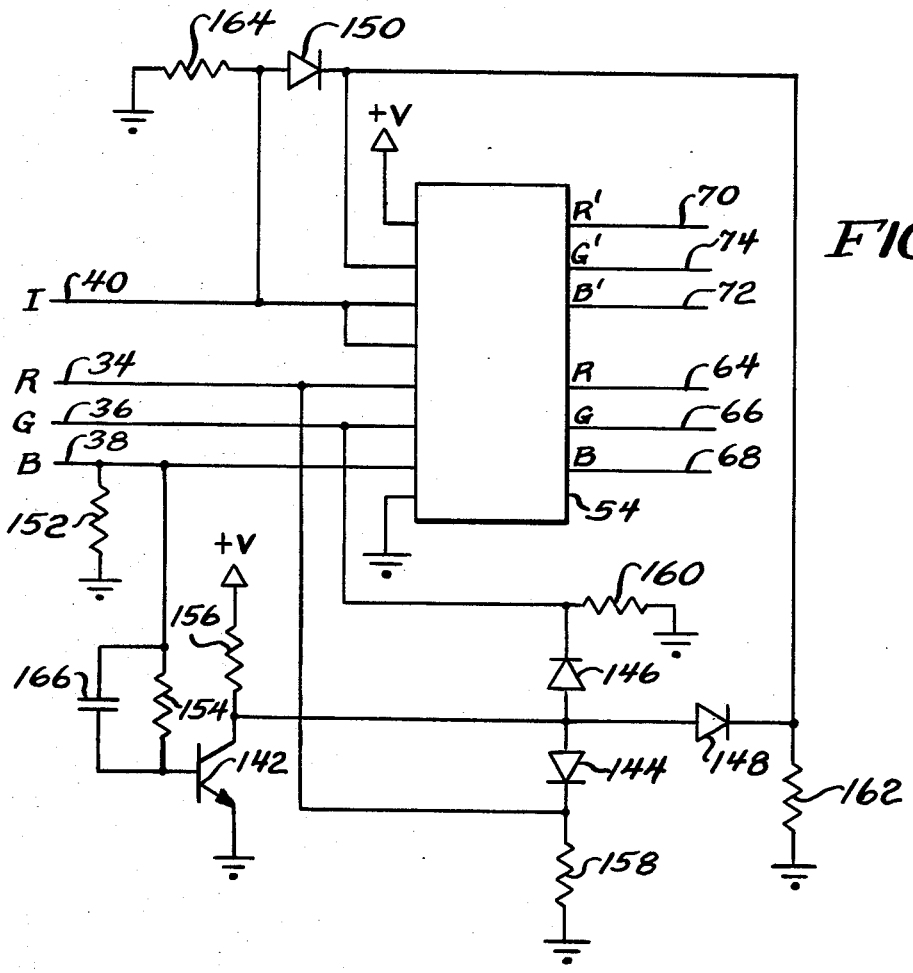
FIG. 6 is a schematic diagram showing one implementation of the logic circuitry of FIG. 5 incorporated into the embodiment of FIG. 3.

FIG. 6 generally illustrates the implementation of a discrete element logic circuit, equivalent to the representational circuit of FIG. 5, shown as it would be to be added to the detailed schematic circuit of FIG. 3 to implement the desired function of logic circuit 32 to recognize a brown tone. More particularly, transistor 142, diodes 144, 146, 148 and 150, resisters 152, 154, 156, 158, 160, 162 and 164 and peaking capacitor 166 operate to implement the desired logic functions by identification of the input signals for which a "brown" output shade is desired.

Referring again to FIG. 3, therein is shown Line 60 (first shown in FIG. 2) which ties the intensity control circuit 56, with its variable voltage supply circuit 90, to node 129 which is controlled by the action of potentiometer 130 of overall image strength control circuit 58. In this fashion, the preferred embodiment of the present invention limits the upper value of the intensity information (R′, G′, B′) by means of the consumer controlled overall image strength control.

The circuitry of the preferred embodiment of the present invention may also be temperature compensated to provide acceptable performance over a broad range of temperatures. Any acceptable method may be used to provide such compensation as is known in the art.

The present invention has been described above in terms of a preferred embodiment in a number of schematic diagrams illustrating implementation of desired circuits. It will be appreciated by those skilled in the art that a number of alterations and modifications may be made without escaping the spirit and scope of the present invention. The present invention is defined with particularly in the appended claims and it embraces all such modifications as would be deemed to fall within the spirit and scope of the present invention as described above.

We claim:

1. A video control system for processing R, G, B and intensity (I) digital color video signals comprising:

logic means for producing R′, G′ and B′ digital signals in response to at least the intensity (I) digital color video signal;

first means for controllably varying the level of said R′, G′ and B′ signals; and second means for controllably combining each of the level controlled R′, G′ and B′ signals with a respective one of the R, G, B digital color video signals for producing variable level analog R, G, B output signals.

2. The video control system of claim 1 further including output control means for controlling said second means.

3. The video control system of claim 2 wherein said first means comprises intensity control means responsively coupled to the output control means for establishing the highest level to which said R′, G′ and B′ signals can be varied by said first means.

4. The video control system of claim 3 wherein said output control means comprises a source of operating potential and a first selectively operable potentiometer for generating an output control signal for controlling said second means and wherein said intensity control means comprises a second selectively operable potentiometer responsive to said output control signal for generating an intensity control signal for controlling said first means.

5. The video control system of claim 4 wherein said second means comprises three resistive matrices each responsive to said output control signal and to a respective pair of said level controlled R′, G′ and B′ signals and said R, G, B signals for producing said variable level analog R, G, B output signals.

6. The video control system of claim 1 wherein said logic means comprises means connected in a wired AND configuration having first and second inputs for receiving said R and G digital color video signals, an open-collector inverter for coupling the B digital color video signal to a third input of said means connected in a wired AND configuration and means connected in a wired OR configuration responsive to the output of said AND gate and the intensity digital color video signal for providing said R′ digital signal.

7. The video control system of claim 1 wherein said logic means is adapted to receive said R,G,B and intensity (I) input signals to recognize input conditions indicative of desired non-standard color shades to generate at least non-standard R′,G′, or B′ signals.

8. An RGBI digital video control system for a color video monitor comprising:

variable intensity control means adapted to rereceive R′,G′ and B′ signals to vary said R′,G′ and B′ signals and to output said varied R′,G′ and B′ signals;

graduation means adapted to receive R,G and B signals and said varied R′,G′ and B signals to combine said R,G and B signals with said R′,G′ and B′ signals to generate RGB analog output signals; and variable image strength control means coupled to said intensity control means to limit said R′,G′ and B′ signals and coupled to said generation means to vary the level of said RGB analog output signals.

9. The RGBI digital video control system of claim 8 further including:

logic means adapted to receive said R,G, and B signals and at least an I input signal to recognize input conditions indicative of desired non-standard color shades to generate corresponding non-standard R,G and B and R′,G′ and B′ signal combinations.

* * * * *